US008959687B2

(12) United States Patent
Bond

(10) Patent No.: US 8,959,687 B2
(45) Date of Patent: Feb. 24, 2015

(54) STRING LINE MULTIPURPOSE TOOL

(76) Inventor: William Ralph Bond, Manassas, VA (US)

( * ) Notice: Subject to any disclaimer, the term of this patent is extended or adjusted under 35 U.S.C. 154(b) by 483 days.

(21) Appl. No.: 13/385,191

(22) Filed: Feb. 7, 2012

(65) Prior Publication Data

US 2013/0198966 A1 Aug. 8, 2013

(51) Int. Cl.
*B25F 1/02* (2006.01)
*B65H 75/24* (2006.01)
*B65H 75/18* (2006.01)

(52) U.S. Cl.
CPC ..... *B65H 75/185* (2013.01); *B65H 75/241* (2013.01)
USPC ..... 7/167

(58) Field of Classification Search
CPC ..... B65H 75/185; B65H 75/241
USPC ..... 7/167; 242/580, 586, 586.2, 608.2, 242/608.6, 905, 405, 405.1, 405.2; 43/43.11
See application file for complete search history.

(56) References Cited

U.S. PATENT DOCUMENTS

| | | | | |
|---|---|---|---|---|
| 470,850 | A * | 3/1892 | Rogers | 223/107 |
| 986,171 | A | 3/1911 | Hoover | |
| 2,650,041 | A * | 8/1953 | Albers | 242/405.2 |
| 3,809,137 | A | 5/1974 | Dombroski | |
| 4,915,320 | A | 4/1990 | Neal | |
| 5,040,256 | A | 8/1991 | Mills | |
| 5,277,350 | A | 1/1994 | Thornbury | |
| 6,289,597 | B1 | 9/2001 | Beyers | |
| 7,017,234 | B2 * | 3/2006 | Anderson | 16/332 |

* cited by examiner

*Primary Examiner* — Bryan R Muller
(74) *Attorney, Agent, or Firm* — Palmer C. DeMeo

(57) ABSTRACT

A multipurpose string line tool having an inner tube slideable within an outer tube provided with an attached bottom end cap and a removable upper end cap whereby a storage space for small construction implements can be stored within the inner tube. A line string is wrapped around the outer tube. The outer tube with the line string wrapped there-around is designed so that it can easily spin around the inner tube thereby providing a free release of the line string. The free end of the line string can be locked within an annular space between the outer tube and a cylindrical stopper by the upper end cap at the upper end of the multipurpose tool. A small opening can be provided in the upper end cap and a pencil sharpener fixed to an inner surface of said upper end cap in alignment with the small opening.

13 Claims, 2 Drawing Sheets

STRING LINE MULTIPURPOSE TOOL

BACKGROUND OF THE INVENTION

1. Field of the Invention

The present invention relates to the use of a multipurpose tool which can be used in carpentry, masonry, landscaping or general construction work. The multipurpose tool includes a string line reel, a storage space and an optional pencil sharpener.

2. Description of the Related Art

Generally, in construction work, it is customary to use a string line device for the alignment of bricks or cement blocks for walls or house foundations, for the alignment of wooden boards for outdoor patios, landscaping alignment of trees and shrubbery, or for other alignment construction projects. It is also customary for carpenters, masonry workers, and general construction workers to carry pencils, ink pens, masonry line pins, small sized rulers, drill bits, wrenches, etc., to facilitate the work of alignment when using a string line device. These construction accessories are generally available in the apron pockets of a construction worker or in a tool box. A pencil sharpener is sometimes needed to sharpen the pencils carried by the construction worker and such is combined with a string line device as evidenced by the patent to Byers (U.S. Pat. No. 6,289,597). Hollow, cylindrical, string line reels are also found in the prior art such as patents to Hoover (U.S. Pat. No. 986,171) and to Thornbury (U.S. Pat. No. 5,277,350). However, neither of these patents discloses an accessible storage space or enclosure for storing construction accessories as disclosed in the present invention.

SUMMARY OF THE INVENTION

The main purpose of this invention is to provide a multipurpose string line tool which facilitates a fast release spin string and has a storage space or enclosure. The string line tool of this invention is composed of only a few parts such as an inner elongated cylinder, an outer elongated cylinder around which is wound a string line, and two end caps with one end cap being fixed at one end of the cylinder and another end cap which is removable from the outer elongated cylinder and opposite to the fixed end cap on the inner elongated cylinder. The string line tool of this invention has an empty space within the inner elongated cylinder for storing various construction items such as: small rulers, masonry line pins, drill bits, pencils, fastening nails or screws, small wrenches, etc. The removable end cap can also be provided with an opening in the normally closed end of the removable end cap and a pencil sharpener fixed inside the end cap adjacent the opening.

It is an object of this invention to provide a string line device which is easy to use and to facilitate a fast release spin string from a support reel.

It is another object of this invention to provide a string line multipurpose tool for alignment of various construction projects and for storing various construction items.

It is a further object of this invention to provide a string line tool made of a few simple parts.

It is another object of this invention to provide a multipurpose tool with a pencil sharpener built therein.

It is a further object of this invention to provide a simple means for securing the free end of the string to the reel to insure no unwinding of the string when the string line tool is not in use.

Other objects and advantages in the use of the multipurpose string line tool of this invention will become more apparent upon reading the following description of which the attached drawings form a part.

DETAILED DESCRIPTION OF THE PREFERRED EMBODIMENTS

Figure 1:
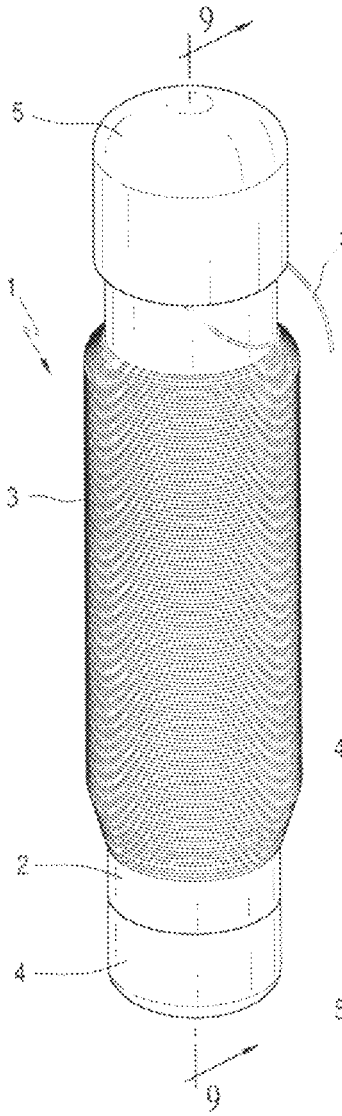
FIG. 1 is a perspective view of the multipurpose string line tool of this invention.
Figure 2:
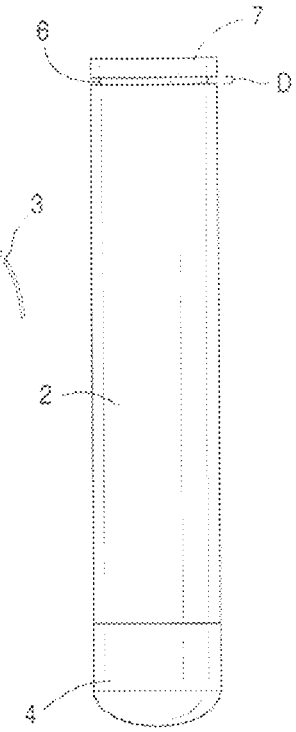
FIG. 2 is a perspective view of the outer part of the multipurpose string line tool of this invention with the upper cap removed.
Figure 3:
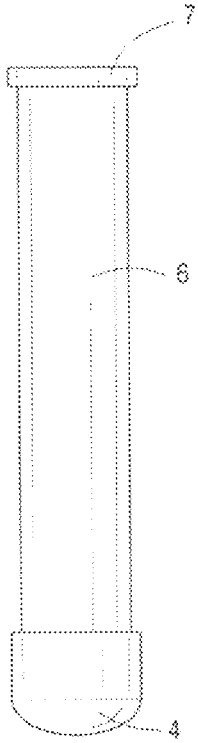
FIG. 3 is a perspective view of an inner part of the string line tool of this invention with the outer cylinder and upper cap removed.
Figure 4:
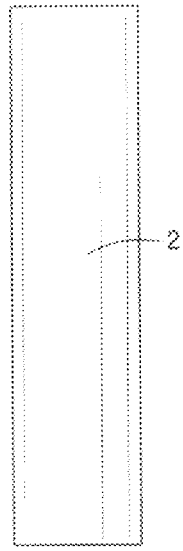
FIG. 4 is a perspective view of the outer cylinder of the string line tool of this invention.
Figure 3A:
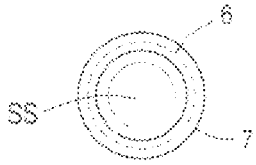
FIG. 3*a* is a top planar view of the upper end of FIG. 3.
Figure 4A:
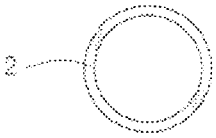
FIG. 4*a* is a top planar view of the upper end of FIG. 4

Referring to FIGS. 1-4. In FIG. 1, there is shown the string line tool 1 of this invention comprising an outer tube 2, an inner tube 6 (not shown), a bottom cap 4, an upper cap 5, and line string 3 wrapped around the outer tube 2. The inner tube 6 is shown in FIG. 3 and has a cylindrical stopper 7 affixed to the upper end thereof by, for example, an epoxy adhesive. A cap 4 is attached to the bottom end of the inner tube 6. A top view of the upper end of the assembly of FIG. 3 is shown in FIG. 3*a*. The space within the inner tube 6 forms a storage space SS for a limited number of construction implements selected by the construction worker. A side view of the outer tube 2 is shown in FIG. 4. FIG. 4*a* shows a top view of the upper end of the outer tube 2 shown in FIG. 4. FIG. 2 shows the assembly of the inner and outer tubes 6 and 2, respectively, the cylindrical stopper 7, and the bottom cap 4. The inner and outer tubes (6, 2), the upper and bottom caps (5, 4) and the cylindrical stopper 6 are made from PVC or ABS materials or from other commercially available hard plastics. The line string 5 is made from 18 gauge nylon string, braided or twisted, or from any other commercially available line string. The upper cap 5, which is removable, has a tight or snug fit over the upper end of the outer tube 2 but can be easily removed by the construction worker. The upper cap 5 must be long enough so that the side wall thereof sufficiently overlaps the spacing D between the cylindrical stopper 7 and the upper end of the outer tube 2. The bottom cap 4 is attached to the bottom end of the inner tube 6 and has a tight or snug fit with the bottom end of the inner tube 6 but can be pushed on or slid off the inner tube. Alternatively, the bottom cap 4 can be internally threaded and the external surface of the bottom end of the inner tube 6 can be threaded so that the bottom cap 4 can be removed. Another alternative, the bottom cap 4 can be permanently attached to the bottom end of the inner tube 6 by, for example, an epoxy adhesive. However, during actual use of the string line tool of this invention the bottom cap 4 is to remain attached to the bottom end of the inner tube 6. As an example, the outer tube 2 is approximately 7 inches in length having an inner diameter of approximately 1¼ inches, the inner tube 6 is approximately 7¾ inches in length having an inner diameter of approximately 1 inch and the cylindrical stopper 7 is approximately ⅛ inches to ¼ inches thick. The inner and outer tubes (6, 2) may be of different lengths or sizes to hold different lengths of string lines, for examples, rolls of 100', 250', 350', 400', or 500'. The color of the line string 3 is also optional. There is a small spacing between the inner and outer tubes 6, 2 such that the inner tube 3 can be manually slid forwards or backwards within the outer tube 2. The sliding movement of the inner tube 6 within the outer tube 2, once the lower cap 4 is fixed to the bottom end of the inner tube 3, will be limited by the cylindrical stopper 6 affixed to the upper end of the inner tube 6 which will abut against the upper end of the outer tube 2. The sliding distance between the inner tube 6 and outer tube 2 is approximately ⅛ inches. When the inner tube 6 is manually slid forward within the outer tube 2 there will be an annual space D between the cylindrical stopper 7 and the upper end of the outer tube 2 the purpose of which will be explained later.

Figure 5:
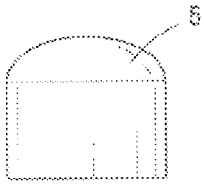
FIG. 5 is a side view of the upper cap 5.
Figure 6A:
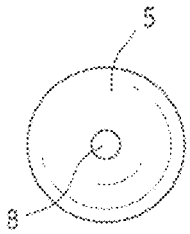
FIG. 6*a* is a top view of a second embodiment of the upper cap shown in FIG. 5.
Figure 5A:
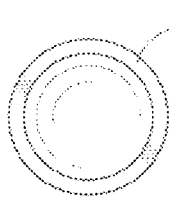
FIG. 5*a* is a bottom planar view of FIG. 5.
Figure 6B:
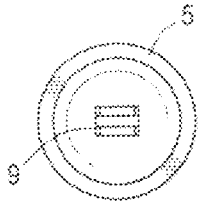
FIG. 6*b* is a bottom view of the second embodiment of the upper cap shown in FIG. 5.

FIGS. 5 and 5*a* show a first embodiment of the upper cap 5 wherein the upper cap 5 is completely enclosed at its upper end. FIGS. 6*a* and 6*b* show a second embodiment of the upper cap 5 wherein there is an opening 8 in the closed end of the upper cap 5 and a pencil sharpener 9 attached to the inner surface at the upper end of the upper cap 5 in alignment with the opening 8 therein. The pencil sharpener 9 is attached to the upper cap 5 by, for example, an epoxy adhesive or any other appropriate commercially available adhesive.

Figure 7:
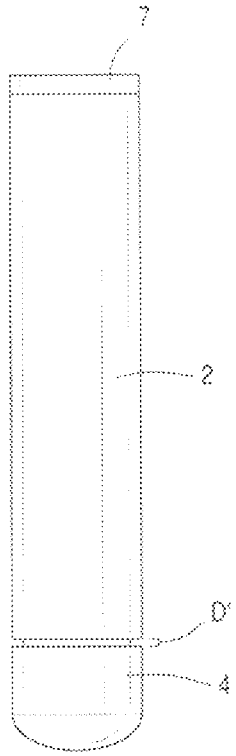
FIG. 7 is a perspective view of the string line tool of the present invention with the inner tube pulled downward showing a lower annular space D'.

FIG. 7 shows an assembly of the inner and outer tubes (6, 2), the cylindrical stopper 7, and the bottom end cap 4 but with the inner tube 6 slid completely down within the outer tube 2 leaving an annular space D' between the bottom of the outer tube 2 and the top of the bottom cap 4. The width of the annular space D' is similar to that of the annular space D in FIG. 2.

Figure 8:
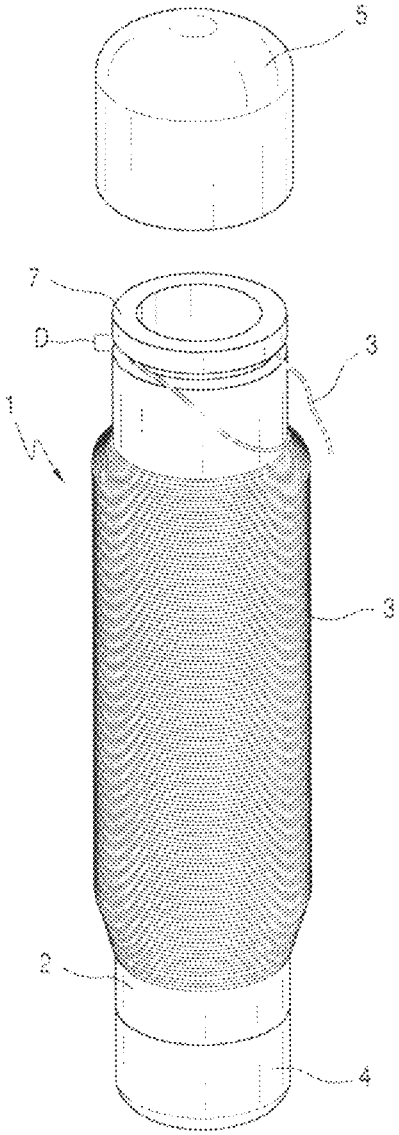
FIG. 8 is a perspective view of the string line tool of the present invention showing an operative step in the use thereof.

FIG. 8 shows the free end the line string 3 wrapped around the inner tube 6 (not numbered) and within the annular space D between the cylindrical stopper 7 and the upper end of the outer tube 2. The reason for this is to lock the free end of the line string 3 to the string line tool 1 by sliding or pushing the upper cap 5 down over the cylindrical stopper 7, annular space D, and the peripheral outer wall at the upper end of the outer tube 2 when the string line tool is not in use. The free end of the line string 3 should extend several inches beyond its locked-in position since this provides a convenient method of carrying the string line tool; FIG. 1 clearly shows this feature.

Figure 9:
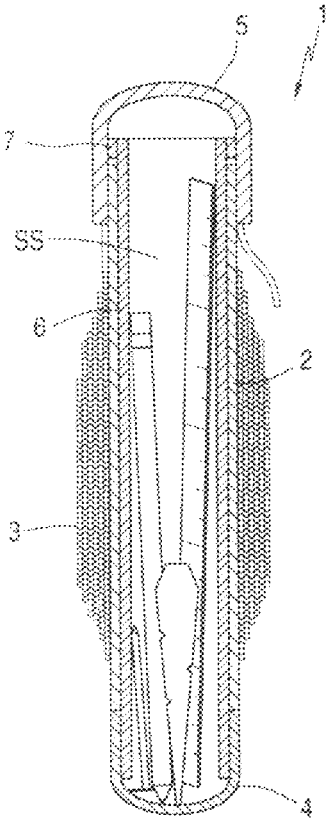
FIG. 9 is a cross-section view through lines 9-9 of FIG. 1 showing some construction implements in the storage space SS of the string line tool of the present invention.

FIG. 9 is a cross-section view of FIG. 1 showing the internal storage space SS of the string line tool of this invention, another feature of this invention, wherein several construction implements can be stored at the discretion of the construction worker. Shown, for example, in the storage space SS are: a ruler, a pencil, a masonry line pin, and a nail.

As mentioned previously, the upper cap 5 can have a completely upper closed end as shown in FIG. 5 or it can have a small opening 8 with a pencil sharpener 9 fixed to an inner surface in alignment with the small opening 8 such as shown in FIGS. 6*a* and 6*b*. A pencil can be sharpened with or without the upper cap 5 being removed from the upper end of the string line tool 1.

As was also mentioned previously, the string line tool 1 of this invention has the feature of the line string 3 having a free release; this is because the outer tube 2 with the line string wrapped there-around can easily spin or rotate around the inner tube 6 by manually holding the bottom cap 4 with one hand and pulling the line string 3 with the opposite hand. The spacing between the inner and outer tubes (6, 2) is designed to provide little resistance between the two tubes during the line string 3 unwinding process.

Modification of this invention will be readily apparent to those skilled in the art and it is intended that the invention be not limited by the embodiments disclosed herein but that the scope of the invention be defined by the appended claims.

What is claimed is:

1. A string line multipurpose tool comprising an elongated outer tube and an elongated inner tube, said inner tube being slideable within said outer tube, said outer tube being freely rotatable around said inner tube, a bottom cap attached to the bottom end of said inner tube thereby providing a storage space within said inner tube for small construction implements, an upper cap removeably attached to the upper end of said outer tube, and a line string wrapped around the outer surface of said outer tube with a free end extending therefrom, wherein said bottom cap is tubular in part having an outer diameter equal to the outer diameter of said outer tube.

2. The string line tool of claim 1 wherein a cylindrical stopper is fixed to the upper end of said inner tube.

3. The string line tool of claim 2 wherein the outer surface of said cylindrical stopper has a diameter equal to the outer diameter of said outer tube.

4. The string line tool of claim 2 wherein said upper cap has a closed end and an open end with said upper cap being a push fit over said cylindrical stopper and the upper end of said outer tube.

5. The string line tool of claim 1 wherein said upper cap has a closed end except for an opening at the center thereof and a pencil sharpener fixed to an inner surface of said upper cap in alignment with said opening and wherein said upper cap has an open end which has a push fit over said cylindrical stopper and the upper end of said outer tube.

6. The string line tool of claim 4 wherein there is an annular space between said cylindrical stopper and said upper end of said outer tube when the upper end of said bottom cap is abutting the lower end of said outer tube.

7. The string line tube of claim 6 wherein the free end of said line string surrounds in part said annular space and extends there beyond.

8. The string line tube of claim 7 wherein said upper cap encloses said cylindrical stopper, said annular space, said free end of said line string and the upper end of said outer tube.

9. The string line tube of claim 4 wherein there is an annular space between the bottom end of said outer tube and said upper end of said bottom cap when the bottom end of said cylindrical stopper is abutting the upper end of said outer tube.

10. The string line tool of claim 5 wherein there is an annular space between said cylindrical stopper and said upper end of said outer tube when the upper end of said bottom cover is abutting the lower end of said outer tube.

11. The string line tube of claim 10 wherein the free end of said line string surrounds in part said annular space and extends there beyond.

12. The string line tube of claim 11 wherein said upper cap encloses said cylindrical stopper, said annular space, said free end of said line string, and said upper end of said outer tube.

13. The string line tube of claim 5 wherein there is an annular space between the bottom end of said outer tube and said upper end of said bottom cap when the bottom end of said cylindrical stopper is abutting the upper end of said outer tube.

* * * * *